US009443408B2

(12) United States Patent
Rennie et al.

(10) Patent No.: US 9,443,408 B2
(45) Date of Patent: Sep. 13, 2016

(54) PNEUMATIC SENSING APPARATUS

(71) Applicant: Kidde Technologies, Inc., Wilson, NC (US)

(72) Inventors: Paul Alan Rennie, Berkshire (GB); Paul David Smith, Camberley (GB)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 203 days.

(21) Appl. No.: 14/211,696

(22) Filed: Mar. 14, 2014

(65) Prior Publication Data

US 2014/0266746 A1 Sep. 18, 2014

(30) Foreign Application Priority Data

Mar. 14, 2013 (GB) ..... 1304573.7

(51) Int. Cl.
*G08B 21/00* (2006.01)
*G08B 17/04* (2006.01)

(52) U.S. Cl.
CPC ..... *G08B 17/04* (2013.01)

(58) Field of Classification Search
CPC ..... G08B 17/04
USPC ..... 340/626–632
See application file for complete search history.

(56) References Cited

U.S. PATENT DOCUMENTS 3,064,245 A 11/1962 Lindberg, Jr.
3,122,728 A 2/1964 Lindberg, Jr.
5,136,278 A 8/1992 Watson et al.
5,515,459 A * 5/1996 Farhadiroushan .... G01L 11/025 385/11
5,657,405 A * 8/1997 Fujiwara ..... G01D 5/268 356/225
5,691,702 A 11/1997 Hay
6,121,883 A * 9/2000 Hatsir ..... G08B 17/04 340/449
6,563,970 B1 5/2003 Bohnert et al.
6,768,825 B2 * 7/2004 Maron ..... G01L 1/246 385/13
7,104,141 B2 * 9/2006 Zerwekh ..... G01K 11/3206 374/E11.016
7,418,171 B2 8/2008 Grattan et al.
7,891,241 B2 * 2/2011 McSheffrey ..... A62C 37/50 169/23
8,074,501 B2 12/2011 Kummer et al.
8,176,790 B2 5/2012 Birch et al.
8,253,954 B2 8/2012 Eguchi et al.
2002/0003917 A1 * 1/2002 Sherrer ..... G01L 9/0079 385/12
2002/0017989 A1 * 2/2002 Forster ..... G01S 5/0018 340/540
2004/0121478 A1 * 6/2004 Brinz ..... G01N 21/783 436/109
2005/0270150 A1 * 12/2005 Freiling ..... B64D 45/0015 340/521
2007/0252998 A1 * 11/2007 Berthold ..... G01D 5/268 356/450
2009/0236205 A1 9/2009 Nalla et al.
2011/0048136 A1 3/2011 Birch et al.
2011/0121977 A1 5/2011 Nalla et al.
2011/0264398 A1 10/2011 Niewczas et al.
2013/0201022 A1 * 8/2013 Brigham ..... G08B 17/107 340/584

FOREIGN PATENT DOCUMENTS

CN 2044364 U * 9/1989
GB 961143 6/1964

* cited by examiner

*Primary Examiner* — Eric M Blount
(74) *Attorney, Agent, or Firm* — Cantor Colburn LLP

(57) ABSTRACT

A pneumatic sensing apparatus for use in an overheat or fire alarm system comprising a sensing assembly that comprises a sensing means 51, 61, 71, containing a pressurized gas, coupled to a pressure sensor 52, 62, 72. The pressure sensor 52, 62, 72, is configured to produce a signal that is indicative of the gas pressure. The pressure sensor 52, 62, 72, comprises an optical pressure sensor and the signal comprises an optical signal.

12 Claims, 4 Drawing Sheets

PNEUMATIC SENSING APPARATUS

CROSS REFERENCE TO RELATED APPLICATION

The present application claims the benefit of GB application number 1304573.7 filed Mar. 14, 2013, the content of which is hereby incorporated by reference in its entirety.

TECHNICAL FIELD

The examples described herein relate to a pneumatic sensing apparatus that may be used in, amongst other applications, a fire alarm system. The sensing apparatus may be used in a fire alarm system in an aeroplane.

BACKGROUND

A known overheat or fire alarm system comprises a sensor tube in fluid communication with a pneumatic pressure detector, also known as a pressure switch module. The sensor tube commonly comprises a metallic sensor tube containing a metal hydride core, typically titanium hydride, and an inert gas fill, such as helium. Such a system is shown in U.S. Pat. No. 3,122,728 (Lindberg).

Exposure of the sensor tube to a high temperature causes the metal hydride core to evolve hydrogen. The associated pressure rise in the sensor tube causes a normally open pressure switch in the detector to close. This generates a discrete alarm. The pneumatic pressure detector is also configured to generate an averaging overheat alarm due to the pressure rise associated with thermal expansion of the inert gas fill. The discrete and average alarm states may be detected as either a single alarm state using a single pressure switch or separately using at least two pressure switches.

It is also common practice to incorporate an integrity pressure switch that is held closed, in normal temperature conditions, by the pressure exerted by the inert gas fill. A known pneumatic pressure detector having an alarm switch and an integrity switch is shown in U.S. Pat. No. 5,136,278 (Watson et al.). The detector uses an alarm diaphragm and an integrity diaphragm having a common axis.

SUMMARY

A pneumatic sensing apparatus for use in an overheat or fire alarm system is described herein and comprises a sensing assembly comprising a sensing means containing a pressurized gas, coupled to a pressure sensor, wherein the pressure sensor is configured to produce a signal that is indicative of the gas pressure. The pressure sensor comprises an optical pressure sensor and the signal comprises an optical signal.

In some of the examples described herein, the sensing apparatus may further comprise a control unit, the control unit comprising an interrogator, wherein the pressure sensor is in communication with the interrogator. The interrogator may further comprise means to receive the signal from the pressure sensor and may also further comprise means to process the signal to provide data indicating the gas pressure.

In examples described herein, the sensing apparatus may further comprise alarm means. The interrogator may be in communication with the alarm means and the interrogator may further comprise means to compare the data indicative of the gas pressure to a first gas pressure threshold, the interrogator further being configured to activate the alarm means to provide an alarm output based on the comparison to the first gas pressure threshold.

In an example described herein, the pressure sensor may be responsive to a change in pressure of the pressurized gas and configured to produce a signal that is indicative of that pressure change.

In an example described herein, the optical pressure sensor may be connected to the interrogator via an optical fibre.

In an example described herein, the interrogator may be configured to activate the alarm means if the signal is above the first pressure threshold, thereby indicating an overheat.

In an example described herein, the interrogator may be configured to activate the alarm means if the signal is below the first pressure threshold, thereby indicating a fault in the apparatus.

In an example described herein, the interrogator may be configured to activate the alarm means if the signal is above the first pressure threshold, thereby indicating an overheat and further configured to activate the alarm means if the signal is below a second pressure threshold, thereby indicating a fault in the apparatus.

In an example described herein, the alarm means may have first and second alarm output means and the interrogator may be configured to activate the first alarm output means if the signal is above the first pressure threshold, thereby indicating an overheat and further configured to activate the second alarm output means if the signal is below the second pressure threshold, thereby indicating a fault in the apparatus.

In an example described herein, the interrogator may be configured to process the optical signal indicative of gas pressure to provide data that indicates whether said sensed pressure is above and/or below a plurality of pressure thresholds, and the interrogator may be configured to activate the alarm means if the signal is above and/or below said plurality of pressure thresholds.

In an example described herein, the interrogator may be configured to continuously receive and process the signal indicative of gas pressure from the optical pressure sensor and to provide data indicative of the gas pressure, and/or a change in gas pressure, based on the continuously received pressure signal. In one example the interrogator may be configured to process that data and provide further information based on that data.

In one example, the information may be a rate of rise of gas pressure. In another example, the information may be long term trending of the gas pressure.

In one example the interrogator may be configured to process data indicative of a continuously variable pressure signal and provide information based on that data. In one example, the information may be a rate of rise of gas pressure. In another example, the information may be long term trending of the gas pressure.

In an example described herein, the sensing apparatus may further comprise a plurality of sensing assemblies. In this example, the control unit may also further comprise a multiplexer that is in communication with the plurality of sensing assemblies and also in communication with the interrogator. The multiplexer may be configured to receive the signal from the pressure sensors of each of the plurality of sensing assemblies and transmit these signals to the interrogator for processing.

The plurality of sensing assemblies may be in communication with the multiplexer via an optical fibre or fibres and each of the signals may be transmitted from the plurality of pressure sensors to the multiplexer via these optical fibre or fibres.

In an example described herein, the sensing apparatus may further comprise an optical fibre distributed sensor, and the optical fibre distributed sensor and the sensing assembly or assemblies may be connected to a multiplexer, the multiplexer further being configured to transmit a signal from the optical fibre distributed sensor and the sensing assembly or assemblies to the interrogator for processing.

In a further example described herein, the apparatus may further comprise a plurality of these optical fibre distributed sensors, the multiplexer further being configured to transmit a signal from each of the plurality of optical fibre distributed sensors to the interrogator.

In any of the examples described herein, the multiplexers described may be connected to the interrogator via an optical fibre or fibres. In one example, the multiplexer ma be connected to the interrogator via a single optical fibre.

In any of the examples described herein that comprise a control unit, the control unit may be located near to, or remotely from the sensing assembly.

In any of the examples described herein, the optical fibre(s) used to connect the pressure sensor(s) to the multiplexer and/or the interrogator may comprise a polyamide coated silica fibre.

In a further example, at least a part of the optical fibre(s) used to connect the pressure sensor(s) to the multiplexer and/or the interrogator may comprise a metal clad silica fibre.

In a further example, at least a part of the optical fibre(s) used to connect the pressure sensor(s) to the multiplexer and/or the interrogator may comprises a sapphire fibre.

The pressure sensor(s) may comprise an intensity based optical fibre pressure sensor.

The pressure sensor(s) may comprise a Fibre Bragg Grating sensor.

The pressure sensor(s) may comprise a Fabry-Perot based pressure sensor.

In an example wherein the pressure sensor comprises a diaphragm, the pressure diaphragm may be formed at least partially from etched silicon, and may be formed at least partially from etched silicon carbide. The pressure diaphragm may also be formed at least partially from a metal. In one example, the metal may comprise TZM alloy.

Examples of pressure sensing apparatuses will now be described with reference to the drawings.

DETAILED DESCRIPTION

Figure 1:
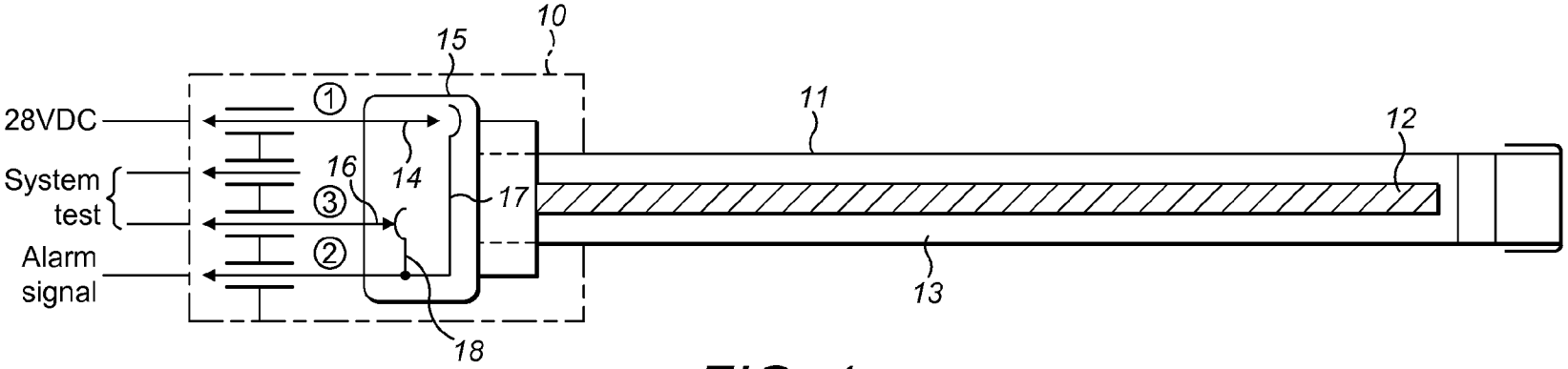
FIG. 1 is a schematic diagram showing a known pneumatic sensing device.

An example of a known type of pneumatic pressure detector fire alarm system, such as that described in U.S. Pat. No. 5,691,702, is shown in FIG. 1. The detector includes electrical circuitry connected to terminal 1 to provide a 28-volt DC voltage. A capillary sensor tube 11 is connected to a responder assembly 10. Such capillary sensor tubes may be placed, for example, in the compartment of an aircraft where fire or overheat conditions are to be detected. In one example, the sensing tube may be positioned in an engine compartment of an aeroplane.

The sensor tube comprises a core element 12, which stores hydrogen gas and is configured to allow a gas path in the event of sensor damage such as crushing or kinking. The wall 13, encloses the core and seals in pressurized helium gas.

The responder assembly 10, comprises a gastight plenum 15, to which the sensor tube 11, is connected. The responder assembly further contains both an alarm switch 14, and an integrity switch 16. Terminal 2, which is connected to metallic diaphragms 17 and 18, provides an alarm signal whenever one switch closes and the other switch opens, as described below.

The ambient helium gas pressure provided in the sensor tube 11, is directly related to the average temperature within the area which the detector is to be positioned and so an increase in temperature in the region of the sensing tube 11, causes a proportionate rise in helium gas pressure. In a situation wherein the compartment temperature rises to the factory set alarm rating, the diaphragm 17, that is within the gas plenum 15, is therefore forced against the contact 1, thereby closing the normally open alarm switch and so activating the alarm. When compartment cooling occurs, the gas pressure reduces, thereby opening the alarm switch, so that the alarm is no longer activated and it is ready to respond again. When an actual fire is indicated, as opposed to an overheat, hydrogen gas in the core 12, is released to close the alarm switch.

In an event wherein the sensor tube 11, is cut, helium gas escapes, thereby causing diaphragm 18, which is normally closed against the contact 3, to open integrity switch 16, thereby signifying failure of the system.

A further example described in U.S. Pat. No. 5,691,702 has an associated control electronics stage (not shown in FIG. 1) which is remotely located from the responder assembly and which is provided to receive, process and indicate signal conditions which are present within the responder assembly. A single lead connects the remote control electronics stage to the responder assembly.

A further example of a known pneumatic fire detector apparatus is described in US 2009/0236205 A1. The fire alarm system incorporates a titanium or vanadium wire inserted into a capillary sensor tube. The wire is exposed to high temperature and pressurized hydrogen gas and absorbs the gas and stores it as the wire cools. This saturated wire is inserted into a sensor tube, pressurized with an inert gas, and sealed at both ends forming a pressure vessel, which can then be used as a pneumatic detector. One of the ends is incorporated into a housing that comprises a plenum, where the alarm and integrity switches are located. When the sensor tube portion of the pneumatic detector is exposed to an increasing temperature, the pressure inside the sensor tube also rises. Pre-formed metal diaphragms are positioned to provide an open switch (alarm switch) and a closed switch (integrity switch). In the event of an overheat, or fire condition, the pressure in the sensor tube and plenum rises and if a pre-determined high temperature condition is reached, the pressure within the plenum increases to such an extent that the diaphragm will be deformed so as to close the alarm switch and thereby activate the alarm. Conversely, for the integrity switch configuration, the diaphragm is deformed so that it responds to a pre-determined drop in background pressure, to lose electrical contact and create an open switch. Electrical wiring is used to connect the respective alarm and integrity switches to an electronic control unit.

Although such pneumatic pressure detectors do not rely on electron conduction mechanisms as their principal mode of operation, they still use a pressure switch that closes an electrical contact as described above. A disadvantage of this is that such sensors experience electromagnetic interference issues. Moreover, since the control unit for such sensors is usually positioned remotely from the compartment of the aircraft in which the sensing tube is positioned, these electromagnetic interference issues are increased by the fact that long electrical cables must then be used to route the signal back to the control unit.

A new pneumatic linear sensor is therefore described herein, that overcomes problems associated with such known sensors and the electromagnetic interference which they experience.

Figure 4:
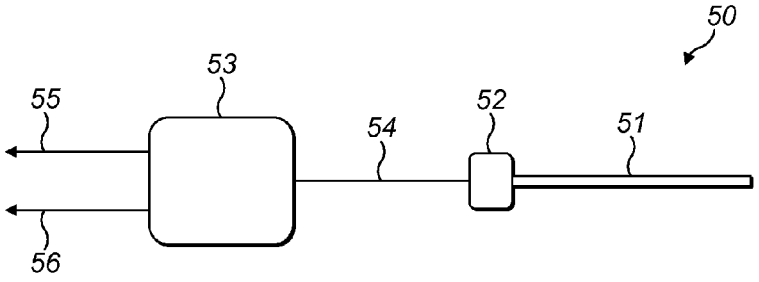
FIG. 4 is a schematic diagram showing on example of a sensing apparatus as described herein.
Figure 5:
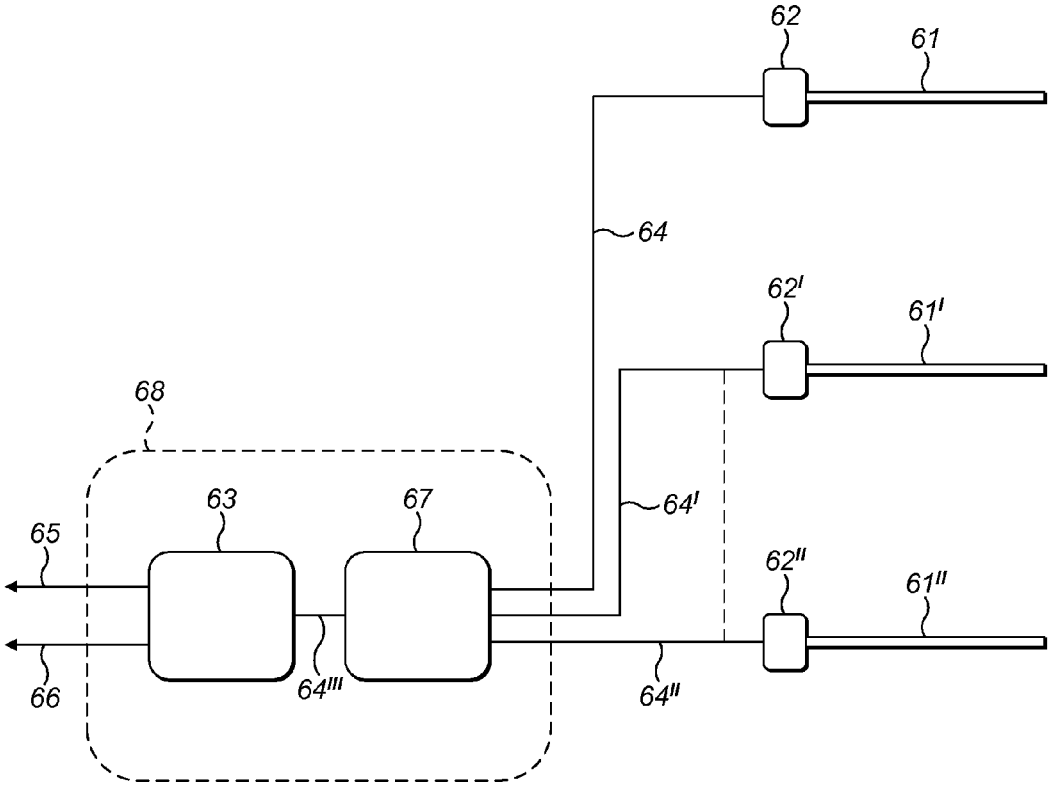
FIG. 5 is a schematic diagram showing a further example of a sensing apparatus as described herein.
Figure 6:
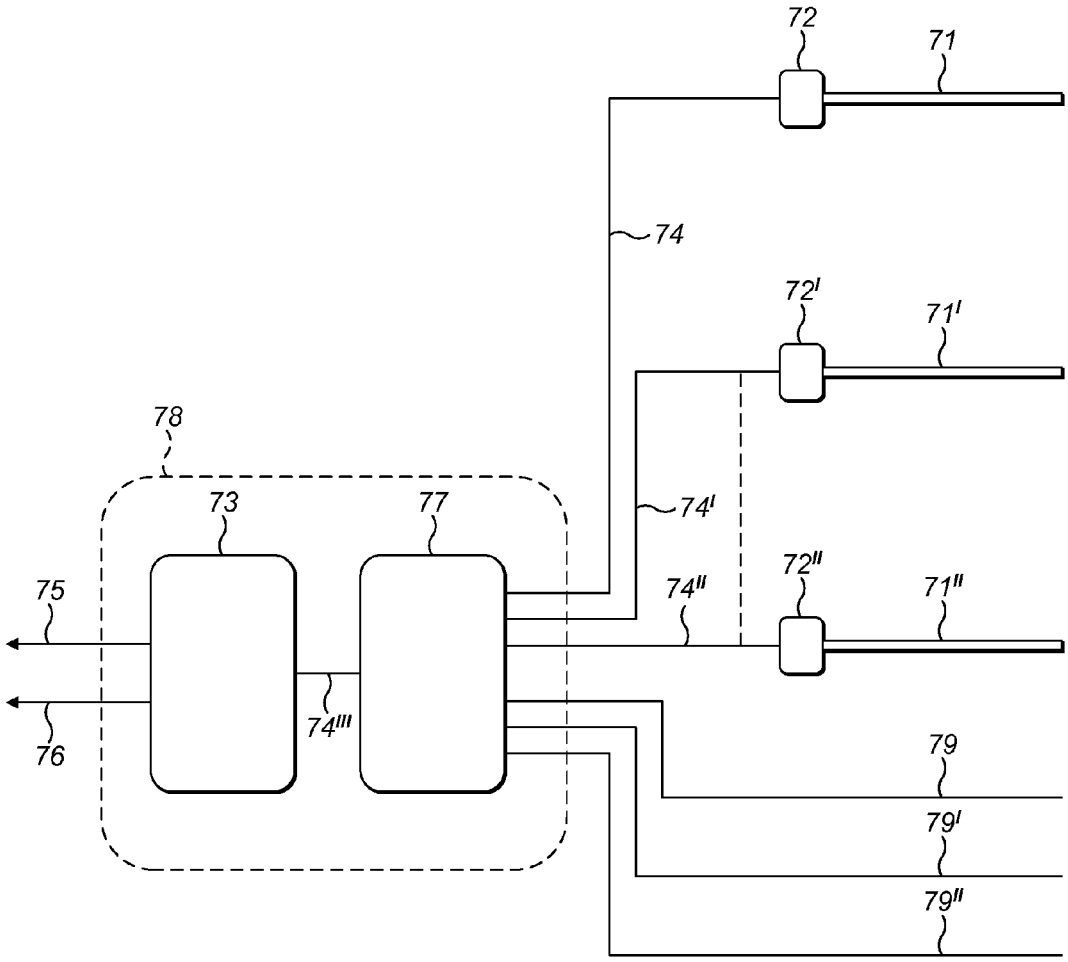
FIG. 6 is a schematic diagram showing a further example of a sensing apparatus as described herein.

In the examples shown in FIGS. 4, 5 and 6, the new sensor apparatus comprises a sensing assembly that comprises a sensing means 51, 61, 71, and an optical pressure sensor, 52, 62, 72. The optical pressure sensor, 52, 62, 72, is therefore used instead of an electrical pressure switch. The optical pressure sensor may be used in conjunction with an interrogator 53, 63, 73, which may be provided in a control unit 58, 68, 78 (not shown in FIG. 4), which may, or may not be located remotely from the optical pressure sensor 52, 62, 72. An optical fibre 54, 64, 74, may further connect the optical pressure sensor 52, 62,72 to the interrogator 53, 63, 73, to thereby route information, via a light signal, from the optical pressure sensor back to the interrogator. Due to this, a new type of sensor is provided that is immune to electromagnetic interference, even if the control unit is provided remotely from the sensing assembly.

In detail, FIG. 4 shows a schematic of the circuitry of a new sensing apparatus 50, which comprises a pneumatic sensing means 51. Any type of pneumatic sensing means may be used, such as those described above and in U.S. Pat. No. 5,691,702 or US 2009/0236205 A1. In one example, the sensing means 51, may comprise a similar capillary sensor tube to that described above with reference to FIG. 1. As described above, with such pneumatic pressure sensors, the helium gas pressure contained in the sensing means is directly related to the temperature being sensed by the sensing means 51.

In contrast to the known example shown in FIG. 1, however, and as shown in FIGS. 4, 5 and 6, instead of being connected to a responder assembly comprising electrical switches, the pneumatic sensing means 51, in this example, is instead, connected to an optical pressure sensor 52, that is responsive to the gas pressure in the sensing means, and/or to a change in the gas pressure in the sensing means, and provides a light signal that is indicative of the gas pressure and/or change in gas pressure to the control unit.

Different types of optical pressure sensors that may be used with the sensing apparatus described herein, include, amongst others, intensity based pressure sensors, F-P based pressure sensors, or FBG based pressure sensors.

Figure 2:
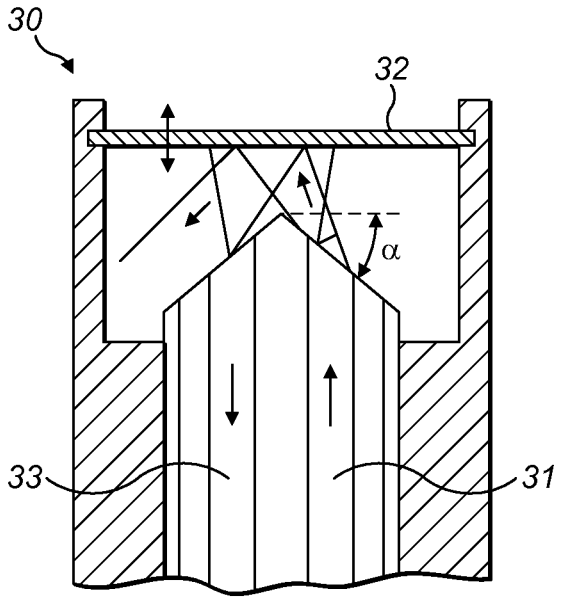
FIG. 2 is a schematic diagram showing a known intensity based optical fibre pressure sensor.

One example of a known intensity based pressure sensor 30, is described in U.S. Pat. No. 8,074,501 B2, and is further depicted in FIG. 2. This figure shows the basic operation of the sensing mechanism of this intensity based optical fibre pressure sensor. Light from one multimode optical fibre 31, is incident upon a diaphragm, 32, that reflects the incident light onto a second multimode fibre 33. An increase in applied pressure, caused for example due to an increase in temperature, causes the diaphragm to deflect and this causes a variation in the intensity of the light collected by the second fibre. If used in the sensing apparatus examples described herein, this would thereby produce a signal that is indicative of the gas pressure, or change in gas pressure, in the pneumatic sensing means.

This sensor and the technique by which it functions is quite simple and it does not require complex and expensive interrogation techniques. In its simplest form all that is required is a low cost LED and photodiode coupled to the respective fibres 31, 33. Although it may be said that this simple approach only has a relatively moderate measurement accuracy and resolution over a relatively narrow pressure range compared to some other sensors, this does not adversely affect the sensor apparatus described herein, as it does not require a high measurement resolution over a wide pressure range. As such, the use of such a relatively simple and low cost intensity based technique provides advantages as it keeps cost to a minimum as well as reducing the complexity of the apparatus.

Figure 3:
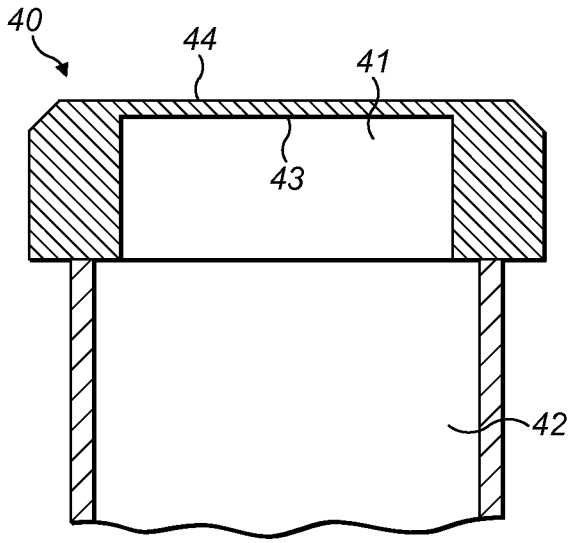
FIG. 3 is a schematic diagram showing a known Faber-Perot based optical fibre pressure sensor.

Another type of known optical pressure sensor that may be used with the sensing apparatus described herein is an Fabry-Perot based pressure sensor 40, such as described in U.S. Pat. No. 8,253,954 B2. FIG. 3 shows the basic operation of the sensing mechanism of this F-P based optical fibre pressure sensor, 40. A Fabry-Perot cavity 41, is formed between the face of the optical fibre 42, and the reflective surface 43, of the diaphragm 44. Light is launched into the fibre and the resulting interference pattern transmitted back along the same fibre to an interrogator (not shown).

The length of the cavity 41, changes as the diaphragm 44, is deflected by pressure and this causes a change in the interference pattern created by the F-P cavity 41. If used in the sensing apparatus examples described herein, this would also thereby produce a signal that is indicative of the gas pressure, or change in gas pressure, in the pneumatic sensing means.

The interrogator for this technique has a higher complexity and cost compared to intensity based techniques, as described above, but offers the advantage of improved measurement accuracy and resolution over a wider range of pressures.

A further type of known optical pressure sensor that can be used with the sensing apparatus described herein is a Fibre Bragg Grating pressure sensor (hereinafter referred to as FBG sensor). These fall into two categories, the first being intrinsic FBG pressure sensors, where the pressure acts directly upon the FBG. This causes an ellipsoidal deformation of the fibre core and a corresponding change in the reflected FBG spectra. The second, more common, approach is indirect pressure measurement where pressure is converted via a suitable transducer into a longitudinal extension or compression of the FBG. The pressure induced change in strain generates a change in the reflected FBG spectra.

Examples of such sensors are provided in U.S. Pat. Nos. 8,176,790 and 6,563,970. In many cases, additional steps have been taken to include a reference FBG to compensate for temperature induced changes in the FBG spectra. Examples of this are described in US 20110048136 and US 20110264398. The interrogator for this technique has a higher complexity and cost compared to intensity based techniques but offers the advantage of improved measurement accuracy and resolution over a wider measurement range.

As described above, the optical pressure sensor 52, 62, 72, may be connected to the interrogator by an optical fibre and may therefore transmit this light signal via this optical fibre, 54, 64, 74, to the interrogator 53, 63, 73, that may be provided within the control unit (not shown in FIG. 4). Since an optical fibre is used, as opposed to an electrical cable, electromagnetic interference does not become an issue, even if the control unit is located remotely from the sensing assembly. The interrogator 53, 63, 73, may then provide initial signal processing dependant on the fibre optic sensing technique employed to provide pressure data that indicates the gas pressure.

In some examples described herein, the interrogator may further comprise means to compare this data to a first gas pressure threshold.

The interrogator may further be connected to an alarm means, that may comprise an alarm output means, and in the examples shown in FIGS. 4 to 6, comprises both first 55, 65, 75, and second alarm output means 56, 66, 76. Of course, any number of alarm output means could be used, depending on choice. The interrogator may therefore use this data regarding gas pressure so as to cause the alarm means to provide an alarm output or outputs based on that data, and/or if such certain, threshold conditions are met.

For example, the signal provided by the optical pressure sensor may be processed by the interrogator to provide data that indicates that the sensed pressure (and therefore temperature) is above a certain defined threshold, such as in the case of a fire, or overheat. In such a situation, the alarm means 55, 56, 65, 66, 75, 76, may have a first alarm output means 55, 65, 66, and the interrogator may be configured to activate this first alarm output means to indicate that there has been a fire or overheat.

Alternatively, the signal may be processed by the interrogator to provide data that indicates that the sensed pressure is below a certain, defined threshold, such as in the case of a fault in the apparatus (for example if sensor integrity has been compromised with subsequent loss of pressure). In this case, the interrogator may be configured to activate the second alarm output means 56, 66, 76, to indicate that there has been a fault.

The control unit may also be configured to react to multiple alarm thresholds or set points and may also be defined to give outputs on, for example, general overheat conditions on expansion of the inert gas fill, or a discrete fire alarm when a short length is heated to a higher temperature and hydrogen is evolved to give a higher pressure.

The control units described herein may therefore provide the added benefit of allowing further signal processing to be carried out by the interrogator. This can provide additional information, for example rate of rise of pressure and hence temperature that is not normally available with previously known systems.

In an example described herein, the interrogator of the control unit may be configured to continuously receive a signal from the optical pressure sensor and to process that signal (which may be continuously variable), to provide data indicative of the gas pressure (and therefore temperature), over time. This may also therefore provide additional information, such as rate of rise or long term trending.

Multiple sensors in different locations, on say an aircraft engine, may also be mapped. In this way, a general temperature increase may be seen as normal operation (within bounds), but a differential between elements may cause an alarm. FIG. 5 shows such a situation, wherein a control unit 68, comprises an interrogator 63, as well as a multiplexer 67, so that multiple sensors may be multiplexed and interrogated by a single control unit 68. Additional interrogators may also be used to provide redundancy for increased reliability.

In this example since multiple sensing assemblies each comprising at least a pressure sensor 62, 62', 62" and a sensing means 61, 61', 61" may be multiplexed on a single fibre optic 64" (74' in FIG. 6), an advantage is provided in that the weight and complexity is saved in comparison to known systems. In addition to this, the fibre optic cables 64, 64', 64" (74, 74', 74" in FIG. 6), connecting the sensor(s) to the control unit may weigh less than an equivalent electrical cable, thereby again reducing the overall weight of the sensor. Multiple sensing assemblies and therefore pressure sensors 62, 62', 62" can also be multiplexed on a single cable.

As shown in FIG. 6, in some instances, in particular when using FBG based optical pressure sensors, it may be possible to use the same electronic control unit 58, 68, 78, to interrogate both a pneumatic fire/overheat detector 51, 61, 71, or plurality thereof, as well as an optical fibre distributed temperature sensor (DTS), or plurality thereof 79, 79', 79" (DTS).

An optical fibre DTS 79, based upon FBG's, such as that disclosed in U.S. Pat. No. 7,418,171, may provide higher fidelity temperature data than pneumatic fire/overheat detectors but such optical fibre DTS sensors are not suitable for the extremely high temperatures (1100° C.) environments for which the pneumatic fire/overheat detectors are designed. This example therefore provides the advantage that optical fibre DTS, 79, may be employed for lower temperature environments (i.e. bleed air leak detection) in conjunction with pneumatic fire/overheat detectors 71, in higher temperature environments (i.e. engine/turbine fire/overheat detection).

Pneumatic pressure detectors or sensors 51, 61, 71, as described herein for fire or overheat detection are required to operate in high temperature environments. The sensing element is generally therefore designed to survive temperatures in excess of 1100° C. The pressure sensing element 52, 62, 72, may also be required to survive similar temperatures.

Such temperatures are a challenge for commonly employed polyamide coated silica optical fibres. Polyamide coated silica optical fibres are limited to ambient temperatures <350° C. Metal clad silica fibres may be employed to extend this to <600° C. The use of sapphire fibres allows this to be further extended to 1100° C. The high cost of sapphire fibre must however be considered. The additional cost can be minimised by only using sapphire fibre in the "hot zone". Outside the "hot zone" this can then be then coupling to standard low cost silica fibre. In one example, therefore, sapphire optical fibres may be used in the region of the pressure sensor(s) 52, 62, 72, and sensing means 51, 61, 71, and the material from which the optical fibre is made can change as it extends away from the high temperature region accordingly.

Pressure diaphragms within the pressure sensors that are formed from etched silicon are similarly challenged at high temperatures and are only suitable for use at temperatures <600° C. In one example, therefore, a metal diaphragm may be used for high temperature operation, such as one made from TZM alloy, for example, (titanium, zirconium, molybdenum). Diaphragms etched from Silicon Carbide may also be an option with the potential to operate at temperatures ≈1100° C.

The examples described herein therefore provide a sensor that is immune to electromagnetic interference. They also further allow for information relating to gas pressure and therefore temperature to be processed by a control unit and since in some examples the variable gas pressure, and therefore temperature, can be measured in comparison to multiple thresholds, and/or measured continuously, trends can be obtained over time, thereby providing a much more detailed analysis of gas pressure and temperature. In addition to this, many different sensors can be multiplexed into one interrogator and the data compiled therein, to create even more detailed analysis than is currently possible. The use of optical fibres also reduces the weight of the system, in comparison to a system that uses many electrical cables.

The invention claimed is:

1. A pneumatic sensing apparatus for use in an overheat or fire alarm system comprising:

a sensing assembly comprising a sensing means containing a pressurized gas, coupled to a pressure sensor; and a control unit, said control unit comprising an interrogator;

wherein said pressure sensor is in communication with said interrogator, said interrogator comprising means to receive said signal from said pressure sensor, and means to process said signal to provide data indicative of said gas pressure;

wherein said pressure sensor is configured to produce a signal that is indicative of said gas pressure, and wherein said pressure sensor comprises an optical pressure sensor and wherein said signal comprises an optical signal;

the sensing apparatus further including alarm means;

wherein said interrogator is in communication with said alarm means; and wherein said interrogator further comprises means to compare said data indicative of said gas pressure to a first gas pressure threshold, said interrogation means further being configured to activate said alarm means to provide an alarm output based on said comparison to said first gas pressure threshold;

wherein said interrogator is configured to activate said alarm means if said signal is below said first pressure threshold, thereby indicating a fault in the apparatus.

2. The sensing apparatus of claim 1, wherein said optical pressure sensor is connected to said interrogator via an optical fibre.

3. The sensing apparatus of claim 1 wherein said interrogator is configured to activate said alarm means if said signal is above said first pressure threshold, thereby indicating an overheat.

4. The sensing apparatus of claim 1 wherein the alarm means comprises a first and a second alarm output means, wherein the interrogator is configured to activate the first alarm output means if the signal is above a first threshold and wherein the interrogator is configured to activate the second alarm output means if the signal is below a second threshold.

5. The sensing apparatus of claim 1 wherein said interrogator is configured to process said optical signal indicative of gas pressure to provide data that indicates whether said sensed pressure is above and/or below a plurality of pressure thresholds, and said interrogator is configured to activate said alarm means if said signal is above and/or below said plurality of pressure thresholds.

6. The sensing apparatus of claim 1 wherein said interrogator is configured to continuously receive and process said signal indicative of gas pressure from said optical pressure sensor and to provide said data based on said continuously received pressure signal.

7. The sensing apparatus of claim 1 wherein said apparatus further comprises;

a plurality of said sensing assemblies; and wherein said control unit further comprises a multiplexer which is in communication with said plurality of sensing assemblies and with said interrogator, said multiplexer being configured to receive said signal indicative of gas pressure from each of said plurality of pressure sensors and transmit said signals to said interrogator.

8. The sensing apparatus of claim 7 wherein said plurality of sensing assemblies are in communication with said multiplexer via an optical fiber or fibres and wherein each of said signals is transmitted from said plurality of pressure sensors to said multiplexer via said optical fibre of fibres.

9. The sensing apparatus of claim 8 further comprising an optical fibre distributed sensor, said optical fibre distributed sensor and said sensing assembly being connected to a multiplexer, said multiplexer further being configured to transmit a signal from said optical fibre distributed sensor and said signal indicative of gas pressure from said sensing assembly to said interrogator.

10. The sensing apparatus of claim 9 further comprising a plurality of said optical fibre distributed sensors said multiplexer further being configured to transmit a signal from each of said plurality of optical fibre distributed sensors to said interrogator.

11. The sensing apparatus of claim 10 wherein said multiplexer is connected to said interrogator via an optical fibre.

12. The sensing apparatus of claim 1 wherein said control unit is located remotely to said sensing assembly.

* * * * *